US007742721B2

(12) United States Patent
Mimbu

(10) Patent No.: US 7,742,721 B2
(45) Date of Patent: Jun. 22, 2010

(54) TRANSFERRING DEVICE HAVING TWO DEVICES FOR CLEANING A TRANSFERRING MEMBER, AND IMAGE FORMING APPARATUS

(75) Inventor: Ryuuichi Mimbu, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 407 days.

(21) Appl. No.: 11/925,211

(22) Filed: Oct. 26, 2007

(65) Prior Publication Data

US 2008/0124155 A1 May 29, 2008

(30) Foreign Application Priority Data

Nov. 27, 2006 (JP) ..... 2006-319156

(51) Int. Cl.
*G03G 21/00* (2006.01)

(52) U.S. Cl. ..... 399/121; 399/101; 399/123; 399/350; 399/302; 399/297

(58) Field of Classification Search ..... 399/101, 399/121, 123, 297, 302, 308, 346, 350
See application file for complete search history.

(56) References Cited

U.S. PATENT DOCUMENTS

| | | | | |
|---|---|---|---|---|
| 5,870,650 | A | 2/1999 | Takahashi et al. | |
| 6,035,157 | A | 3/2000 | Takahashi et al. | |
| 6,901,234 | B2 | 5/2005 | Ogiyama et al. | |
| 6,947,693 | B2 | 9/2005 | Kamiya et al. | |
| 7,162,179 | B2 | 1/2007 | Yoshida | |
| 2004/0160646 | A1 | 8/2004 | Kudo et al. | |
| 2006/0056884 | A1 | 3/2006 | Sawai et al. | |
| 2006/0165450 | A1 | 7/2006 | Koike et al. | |
| 2009/0142083 | A1 * | 6/2009 | Minbu | 399/45 |
| 2009/0245864 | A1 * | 10/2009 | Nakura et al. | 399/121 |

FOREIGN PATENT DOCUMENTS

| | | |
|---|---|---|
| JP | 11-065391 | 3/1999 |
| JP | 2006-003859 | 1/2006 |

* cited by examiner

*Primary Examiner*—David M Gray
*Assistant Examiner*—G. M. Hyder
(74) *Attorney, Agent, or Firm*—Oblon, Spivak, McClelland, Maier & Neustadt, L.L.P.

(57) ABSTRACT

A transferring device installed in an image forming apparatus includes an image bearing member configured to bear toner images on the surface. There is a transferring member configured to contact the image bearing member to form a transferring nip. A lubricant supplying member is configured to supply a lubricant to the surface of the transferring member, and there is a transferring member cleaning member such as a blade configured to remove residual toner and which contacts the surface of the transferring member. There is also a foreign material removing member configured to remove residual foreign material from the surface of the transferring member.

22 Claims, 4 Drawing Sheets

TRANSFERRING DEVICE HAVING TWO DEVICES FOR CLEANING A TRANSFERRING MEMBER, AND IMAGE FORMING APPARATUS

CROSS-REFERENCE TO RELATED APPLICATIONS

The present application claims priority to Japanese patent application no. 2006-319156, filed in the Japan Patent Office on Nov. 27, 2006, the disclosure of which is incorporated by reference herein in its entirety.

BACKGROUND OF THE INVENTION

1. Field of the Invention

The present invention relates to a transferring device, a method and structure for cleaning the transferring device, and an image forming apparatus that includes the transferring device.

2. Discussion of Background

A transferring device transfers toner images formed on an image bearing member to a sheet at a transferring nip between a transferring member, e.g. a transferring roller, and the image bearing member. In this transferring device, toner residue may be picked up on the back side of a sheet at the transferring nip.

Before the sheet is transferred to the transferring nip, toner on the surface of the image bearing member are transferred to the surface of the transferring member. Next, this toner on the surface of the transferring member is transferred to the back side of the sheet.

Japan Laid-Open Patent Publication no. 2006-003859 shows an image forming apparatus that prevents toner residue.

This image forming apparatus transfers toner on the surface of an intermediate transferring belt, serving as an image bearing member, to the front surface of sheet at the second transferring nip which is formed between the intermediate transferring belt and a second transferring roller, serving as a transferring member.

A cleaning blade contacts the surface of the second transferring roller. The cleaning blade removes the toner on the surface of the second transferring roller after passing the second transferring nip, and it prevents the toner on the surface of the second transferring roller from going into the second transferring nip. Thus, it prevents the toner residue on the back side of sheet.

In addition, in this image forming apparatus, a solid lubricant made of zinc stearate is supplied to the surface of the second transferring roller by a rotating lubricant supplying brush.

By applying the lubricant to the surface of the second transferring roller, the adhesion of the toner to the surface of the second transferring roller becomes weak, and the toner removal characteristics from the surface of the second transferring roller improves.

Recently, spherical toner, which has a relatively small diameter and high average roundness, has been used in place of crushed toner, which has a relatively big diameter and a low average roundness. In image forming apparatuses using spherical toner, the spherical toner easily passes through the nip between the surface of the second transferring roller and the cleaning blade, and it is difficult to prevent the occurrence of toner residue on the back side of sheets.

SUMMARY OF THE INVENTION

In order to address the issue of toner residue in a system using spherical toner, the present inventor made the pressure of the cleaning blade against the surface of the second transferring roller stronger than the conventional image forming apparatus. This made it possible to remove the residual spherical toner, which has a relatively small diameter and high average roundness, from the surface of the second transferring roller comparatively very well.

However, the good cleaning ability did not last long, and the toner residue on the back side of sheet exceeding tolerance level began to occur comparatively in a short term.

The reason for the short cleaning ability was studied zealously and the following was learned. Namely, after passing the second transferring nip, other than the spherical toner, paper powder which includes minute fibers which spread directly or indirectly from the sheet adhere on the surface of the second transferring roller.

In a conventional image forming apparatus which has relatively low pressure of the cleaning blade, if the paper powder is caught between the cleaning blade and the second transferring roller, the paper powder easily passes the nip between the cleaning blade and the second transferring roller comparatively in a short term and there is no problem. However, in the image forming apparatus which has relatively high pressure of the cleaning blade, the paper powder caught between the cleaning blade and the second transferring roller stays for a long time, and a little gap forms between the cleaning blade and the second transferring roller. The spherical toner easily passes through the little gap, and toner residue on the back side of sheet occurs.

The present invention can overcome one or more of the above-noted disadvantages. According to one embodiment, the present invention includes a transferring device installed in an image forming apparatus having an image bearing member configured to bear toner images on the surface, a transferring member configured to contact the image bearing member to form a transferring nip between the image bearing member and the transferring member, a lubricant supplying member configured to supply a lubricant on the surface of the image bearing member, an image bearing member cleaning member configured to remove residual toner which contacts the surface of the image bearing member between the transferring nip and a lubricant supplying nip which is between the lubricant supplying member and the image bearing member, and a foreign material removing member configured to remove residual foreign materials which contact the surface of the image bearing member between the transferring nip and a cleaning nip which is between the image bearing member cleaning member and the image bearing member.

The present invention also includes, according to another embodiment, a transferring device installed in an image forming apparatus having an image bearing member configured to bear toner images on the surface, a transferring member configured to contact to the image bearing member to form a transferring nip between the image bearing member and the transferring member, a lubricant supplying member configured to supply a lubricant on the surface of the image bearing member, an image bearing member cleaning member configured to remove residual toner, which contacts the surface of the image bearing member between the transferring nip and a lubricant supplying nip which is between the lubricant supplying member and the image bearing member, and a foreign material removing member configured to remove residual foreign materials which contact the surface of the image bearing member between the transferring nip and a cleaning nip which is between the image bearing member cleaning member and the image bearing member.

It is to be noted that the present invention may be used with any type of toner or developer, and the use of spherical toner is not required.

Other features and advantages of the present invention will become apparent upon consideration of the following description of the preferred embodiments of the present invention taken in conjunction with the accompanying drawings.

BRIEF DESCRIPTION OF THE DRAWING

The accompanying drawings, which are incorporated herein and constitute a part of the specification, illustrate the invention, and together with the description, serve to explain the principles of the invention.

DESCRIPTION OF THE PREFERRED EMBODIMENTS

Figure 1:
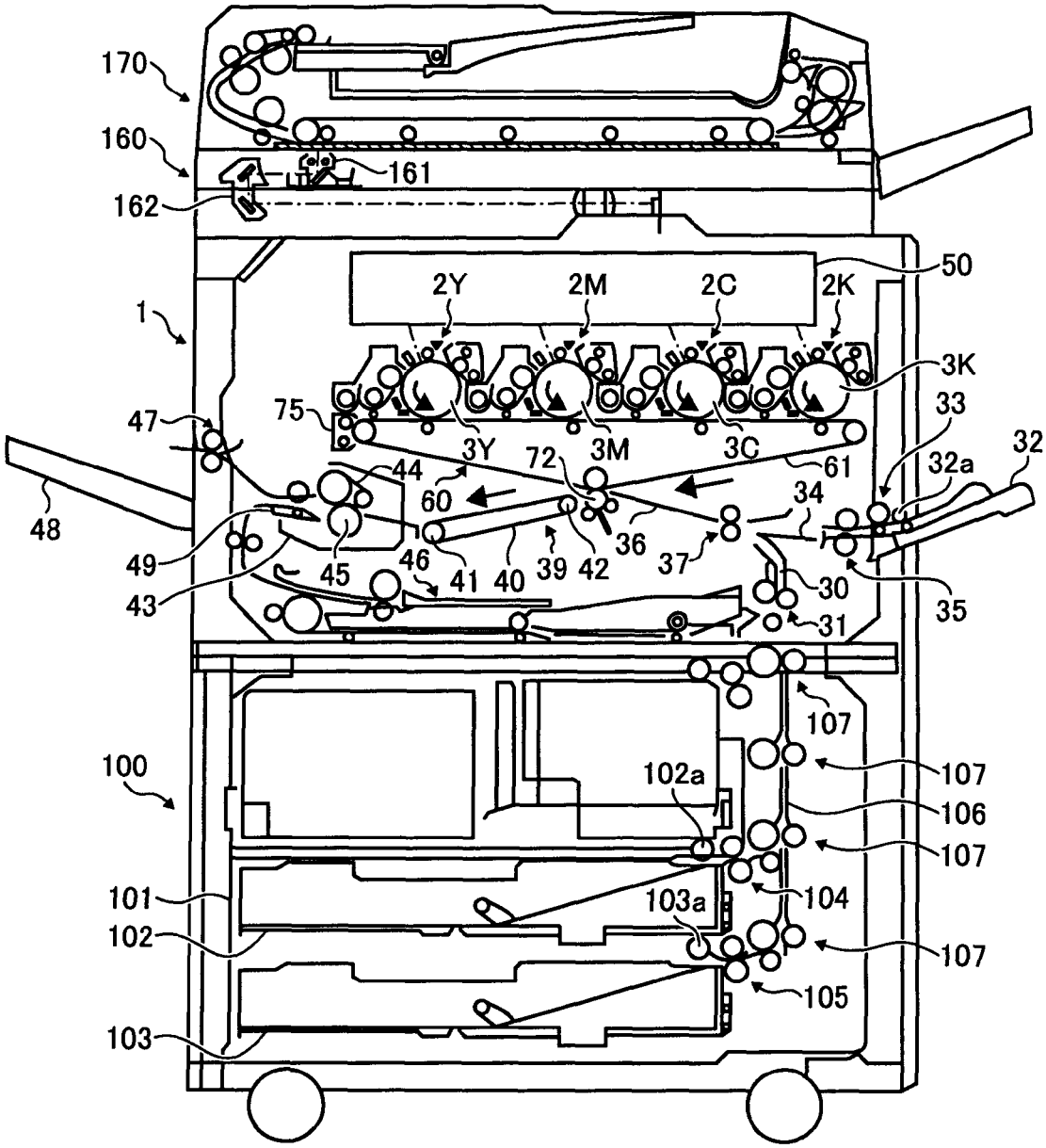
FIG. 1 is a schematic structure of an image forming apparatus, according to an embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described. Referring to FIG. 1, a structure of an image forming apparatus is shown as an example of an image forming apparatus according to an exemplary embodiment of the present invention. The image forming apparatus includes an image forming unit formed of an image forming section 1 and a sheet feed unit 100, a scanner 160, and a document carrying unit or automatic document feeder 170. The scanner 160 is mounted on the image forming section 1, and the document carrying unit 170 formed of an automatic document feeder (ADF) is mounted on the scanner 160.

The sheet feed unit 100 includes two sheet feed cassettes 102 and 103 arranged in multi-stages in a sheet bank 101, two separation rollers 104 and 105, a sheet feed path 106 and carrier rollers 107. The two sheet feed cassettes 102 and 103 accommodate sheets therein. Based on a control signal from the image forming section 1, a top sheet is fed to the sheet feed path 106 by rotating a feeding roller 102*a* or 103*a*. The sheet is fed to the sheet feed path 106 by the separation rollers 104 or 105. The sheet is then fed to a first receipt divergence path 30 of the image forming section 1 via a nip between a pair of a feeding roller 107 arranged in the sheet feed path 106.

The image forming section 1 includes four process units 2Y, 2M, 2C and 2K for forming yellow color, magenta color, cyan color and black color toner images. Furthermore, the image forming section 1 includes a receipt roller 31, a manual feed tray 32, a manual feed separation roller 33, a second receipt divergence path 34, a manual feed roller 35, a pre-second transferring path 36, a registration roller 37, a transferring belt unit 39, a fixing unit 43, a switchback device 46, a discharging roller 47, a discharge tray 48, a switching member 49, a writing unit 50, and a transferring unit 60.

The process units 2Y, 2M, 2C and 2K include photosensitive members 3Y, 3M, 3C and 3K such as image bearing members, respectively. The pre-second transferring path 36, which feeds the sheet to a second transfer nip, receives sheets from the first receipt divergence path 30 and the second receipt divergence path 34.

The sheet fed from the sheet feed path 106 of the sheet feed unit 100 is received by the first receipt divergence path 30, and the sheet is fed to the pre-second transferring path 36 via the receipt roller 31 arranged in the first receipt divergence path 30.

The manual feed tray 32 is arranged on a side of a body of the image forming apparatus. The manual feed tray 32 is opened from the body of the image forming apparatus, and a stack of sheets is placed on an upper surface of the manual feed tray 32. Sheets of the stack are fed to the second receipt divergence path 34 by a roller 32*a* of the manual feed tray 32. Sheets are fed to the receipt divergence path 34 by the manual feed separation roller 33, and subsequently to the pre-second transferring path 36 via the manual feed roller 35 arranged in the second receipt divergence path 34.

The writing unit 50 includes laser diode, polygon mirror and various lenses (not shown). The laser diode is controlled to form an image which is based on an image scanned by the scanner 160 or sent from an external computer. The photosensitive members 3Y, 3M, 3C and 3K of the process units 2Y, 2M, 2C and 2K are exposed by the writing unit 50. The photosensitive members 3Y, 3M, 3C and 3K of the process units 2Y, 2M, 2C and 2K are rotated by a rotating device (not shown) such as a motor in the c direction shown in FIG. 1. The writing unit 50 exposes the photosensitive members 3Y, 3M, 3C and 3K which are rotating about an axis using a rotating polygonal mirror. Thus, electrostatic latent images based on image data are formed on the photosensitive members 3Y, 3M, 3C and 3K.

Figure 2:
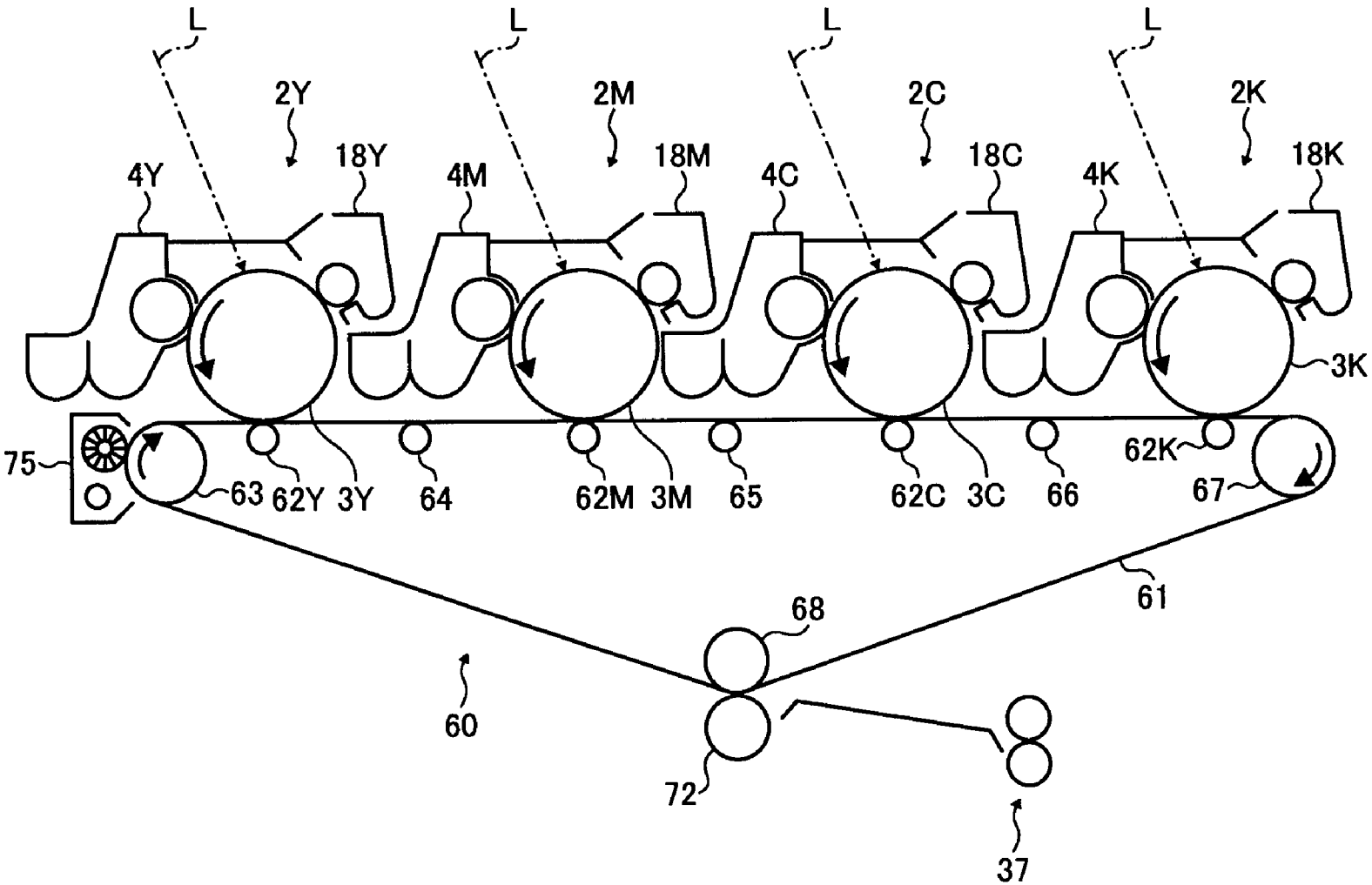
FIG. 2 is an enlarged view of a part of the image forming apparatus.

FIG. 2 is an enlarged view of a part of the image forming apparatus. The process units 2Y, 2M, 2C and 2K support the photosensitive members and the various devices arranged around the photosensitive members to a common support body respectively as one unit, and the process units 2Y, 2M, 2C and 2K are attached detachably to the body of the image forming apparatus. As a general statement, features of the different color sections correspond to each other. For example, the process unit 2Y used to form yellow color images, the process unit 2Y includes the photosensitive member 3Y and the developing device 4Y which develops the electrostatic latent images on the surface of the photosensitive member 3Y. In addition, the process unit 2Y includes a photosensitive member cleaning device 18Y, which removes residual toner on the surface of the photosensitive member 3Y after passing a first transferring nip. As for the image forming apparatus, it is constituted by a so-called tandem-type device that includes four process units 2Y, 2M, 2C and 2K arranged along an intermediate transfer belt 61.

Figure 3:
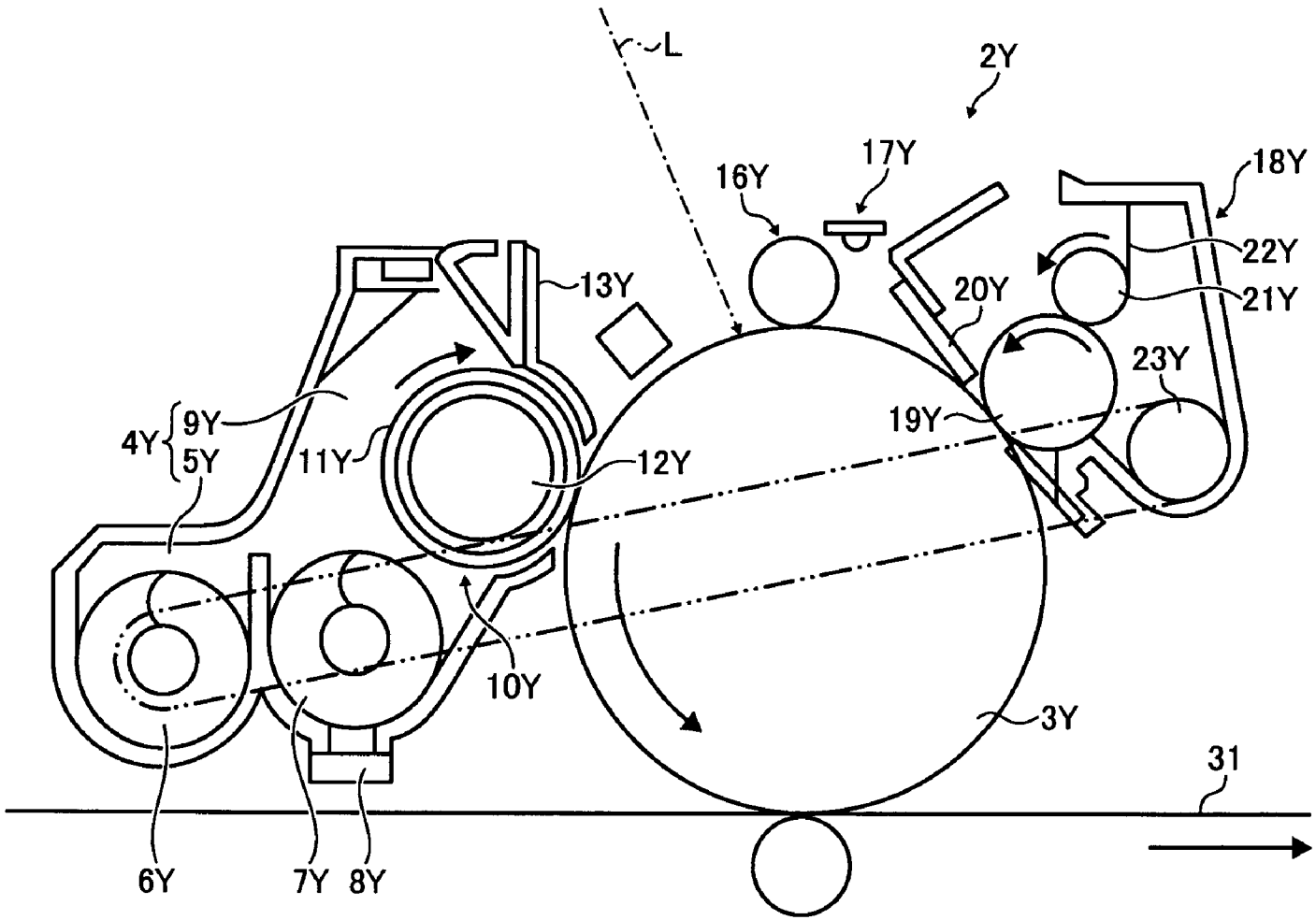
FIG. 3 is an enlarged view of a process unit 2Y.

FIG. 3 shows an enlarged view of the process unit 2Y. As illustrated in FIG. 3, the process unit 2Y includes the developing device 4Y, the photosensitive member cleaning device 18Y, the discharging lamp 17, and the charging roller 16Y which contacts the photosensitive member 3Y. The photosensitive member 3Y includes a drum made of aluminum which has an exposure layer formed by application of organic exposure materials in order to have a photosensitivity. Alternatively, the photosensitive member 3Y can include a photosensitive belt in place of the drum.

The developing device 4Y includes, for example, a two-component developer, which includes magnetic carriers and non-magnetic yellow toner, to develop the electrostatic latent image on the surface of the photosensitive member 1. Furthermore, the developing device 4Y includes an agitating portion 5Y that agitates the developer included inside, and a developing portion 9Y which develops the electrostatic latent images on the surface of the photosensitive member 3Y. However, the developing device 4Y can include a one-component developer which does not include magnetic carrier. The agitating portion 5Y is arranged lower than the developing portion 9Y. The agitating portion 5Y includes a first agitator 6Y and a second agitator 7Y, which are arranged parallel at a same height, a partition plate arranged between the first agitator 6Y and the second agitator 7Y, and a toner density sensor 8Y set up at a bottom of a casing of the developing device 4Y.

The developing portion 9Y includes a developing roller 10Y opposed to the photosensitive member 3Y through an opening of the casing of the developing device 4Y, and a doctor blade 13Y proximate to or contacting the developing roller 10Y. The developing roller 10Y includes a developing sleeve 11Y made of non-magnetic material and a magnet roller 12Y which is preferably stationary inside of the developing sleeve 11Y which is rotatable. The magnet roller 12Y includes a plurality of magnetic poles located in a line in the direction of a circumference. These magnetic poles cause magnetism to act on the developer on the developing sleeve 11Y. The magnetic poles draw the developer on the surface of the developing sleeve 11Y sent from the agitating portion 5Y. Thus, a magnetic brush in alignment with a line of magnetic force is formed on the surface of the magnetic sleeve 11Y. The magnetic brush is regulated to a predetermined layer thickness via a nip between the doctor blade 13Y and the developing blade 11Y along with the rotation of the developing sleeve 11Y, and the magnetic brush is sent to a developing area opposed to the photosensitive member 3Y. Yellow toner of the magnetic brush is developed by a potential difference of a developing bias applied to the developing sleeve 11Y and the electrostatic latent images of the photosensitive member 3Y. After that, the magnetic brush is sent again to the developing portion 9Y with the rotation of the developing sleeve 11Y, and the magnetic brush is removed by a repulsion magnetic field formed by the magnetic poles of the magnetic roller 12Y and returned to the agitating portion 5Y. Toner is replenished to the developers in the agitating portion 5Y based on a detection result of a toner density sensor 8Y.

The photosensitive member cleaning device 18Y includes a cleaning blade 20Y made of polyurethane rubber pressed against the photosensitive member 3Y. The photosensitive member cleaning device 18Y further includes a photosensitive member cleaning brush 19Y, which contacts the surface of the photosensitive member and rotates in the direction of the arrow in FIG. 3, to improve the cleaning ability. If desired, the cleaning brush 19Y further supplies a lubricant powder scratched from a solid lubricant to the surface of the photosensitive member 3Y. This solid lubricant can be located between roller 21Y and the photosensitive member 3Y. The toner stuck to the cleaning brush 19Y is transferred to a electric field roller 21Y, which contacts the cleaning brush 19Y and rotates in a direction counter to the cleaning brush 19Y and to which a bias is applied.

The toner on the electric field roller 21Y is scratched by a scraper 22Y, and falls on a collecting roller 23Y. The collecting roller 23Y conveys the toner towards the end of the direction which intersects perpendicularly with the figure space in the photosensitive member cleaning device 18Y, and delivers the toner to a recycling conveying device (not shown) arranged outside of the photosensitive member cleaning device 18Y. The recycling conveying device conveys the toner to the developing device 4Y for recycling.

A discharging lamp 17Y discharges the photosensitive member 3Y when illuminated. After that, a charging roller 16Y charges uniformly the surface of the photosensitive member 3Y, and the writing unit 50 exposes the surface of the photosensitive member 3Y, as described forward.

The charging roller 16Y has applied thereto a charging bias by a power source (not shown) and rotates. Instead of the charging roller 16Y, a non-contact charging wire, which charges the surface of the photosensitive member 3Y, can be used.

According to the process that has been explained up to now, yellow toner images, magenta toner images, cyan toner images and black toner images are formed on the surface of the photosensitive member 3Y, 3M, 3C and 3K of the process units 2Y, 2M, 2C and 2K, respectively. A transferring unit 60, is arranged below the process unit 2Y, 2M, 2C and 2K. The transferring unit 60 includes an intermediate transferring belt 61 stretched by a plurality of rollers. The intermediate transferring belt 61 contacts the photosensitive member 3Y, 3M, 3C and 3K, and the intermediate transferring belt is moved in the direction of clockwise rotation in FIG. 2 by rotation of any one or more rollers.

First transferring nips are formed between the photosensitive member 3Y, 3M, 3C and 3K and the intermediate transferring belt 61. A first transferring roller 62Y, 62M, 62C and 62K is arranged inside of the intermediate transferring belt 61 at the first transferring nip, and the first transferring roller 62Y, 62M, 62C and 62K is pushed to the photosensitive member 3Y, 3M, 3C and 3K. The first transferring roller 62Y, 62M, 62C and 62K has applied thereto a first transfer bias by one or more power sources (not shown). Thus, a first transferring electric field, which transfers the toner images on the surface of the photosensitive member 3Y, 3M, 3C and 3K to the intermediate transferring belt 61, is formed at each of the first transferring nips.

In FIG. 2, outer peripheral surface of the intermediate transferring belt 61 passes the first transferring nips in a clockwise direction, and the toner images are transferred superposingly to the outer peripheral surface of the intermediate transferring belt 61. Thus, a four color toner superposing image (referred to as a four color toner image hereinafter) is formed on the outer peripheral surface of the intermediate transferring belt 61.

A second transferring roller 72 is arranged below the intermediate transferring belt 61. A second transferring nip is formed between the second transferring roller 72 and a second transferring backup roller 68, which contacts an inner peripheral surface of the intermediate transferring belt 61.

The second transferring roller 72 is grounded, and the second transferring backup roller 68 arranged inside of the intermediate transferring belt 61 has applied thereto a second transferring bias, which has a same polarity as a polarity of the toners, by a power source (not shown). Thus, a second transferring electric field is formed at the second transferring nip.

As illustrated in FIG. 2, a pair of registration rollers 37 is arranged at the right side of the second transferring nip, and the sheet sandwiched by the pair of the registration rollers 37 is fed to the second transferring nip at a timing which is synchronized with the four color toner image on the intermediate transferring belt 61. At the second transferring nip, the four color toner image on the intermediate transferring belt 61 is transferred to the sheet by the second transferring electric field and a pressure between the second transferring roller 72 and the intermediate transferring belt 61. Residual toner, which is not transferred at the second transferring nip, remains on the outer peripheral surface of the intermediate transferring belt 61. The residual toner is removed by an intermediate transferring belt cleaning unit 75, which contacts the surface of the intermediate transferring belt 61.

The sheet is fed from the second transferring nip to the transferring belt unit 39. The transferring belt unit 39 includes a transferring belt 40, a driving roller 41 and a driven roller 42. The transferring belt 40 is rotated by the driving roller 41 in a counterclockwise direction in FIG. 1. The transferring belt unit 39 supports the sheet fed from the second transferring nip on the top surface of the transferring belt 40, and the transferring belt unit 39 transfers the sheet to the fixing unit 43 by rotating the transferring belt 40.

The fixing unit 43 includes a fixing belt 44 which includes a driving roller, which drives the fixing belt 44, and a heating roller including a heat source. A fixing nip is formed between a pressure roller 45, which is arranged under the fixing belt 44, and the fixing belt 44. The four color toner image on the sheet, which is transferred to the fixing unit 43, is fixed by the heat and the pressure at the fixing nip. The sheet is fed from the fixing nip to the switching member 49.

The switching member 49 is moved by a solenoid (not shown), and the switching member 49 switches a path between an ejecting path and an inverting path. When the ejecting path is selected by the switching member 49, the sheet fed from the fixing unit 43 is transferred to the discharging tray 48 arranged outside of the body of the image forming apparatus via the ejecting path and a pair of the discharging roller 47. The switchback device 46 is arranged below the fixing unit 43 and the transferring unit 39. When the inverting path is selected by the switching member 49, the sheet fed from the fixing unit 43 is transferred to the switchback device 46 after carrying out a vertical flip via a reversal path. The sheet is then fed to the second transferring nip, and a four color toner image is transferred on the opposite side and fixed.

The scanner 160 arranged above the image forming section 1 includes a fixed scanning part 161 and a moving scanning part 162 serving as a scanning unit to read or scan an image of a manuscript, sheet, object, or other item. The fixed scanning part 161 includes an image reading sensor and a source of light, a reflecting mirror and a CCD. The fixed scanning part 161 is arranged directly under a first contact glass (not shown) which is fixed to the casing top wall of the scanner 160 so that the manuscript, etc. might be contacted and/or scanned.

When the manuscript passes the first contact glass by the document carrying unit 170, light from the light source is reflected by the manuscript, and the light is received by an image reading sensor via a plurality of reflecting mirrors. Thus, the fixed scanning part 161 scans the manuscript without moving an optical system which includes the light source, the reflecting mirror, etc. On the other hand, the moving scanning part 162 is arranged directly under a second contact glass (not shown) which is fixed to the casing top wall of the scanner 160 so that the manuscript might be contacted, and an optical system which includes the light source, the reflecting mirror, etc. is arranged to move in right and left directions in FIG. 1. When the optical system moves from the left side to the right side in FIG. 1, light from the light source is reflected by the manuscript put on the second contact glass, and the light is received by an image reading sensor fixed to the scanner 160 via a plurality of reflecting mirrors. Thus, the moving scanning part 162 scans the manuscript with a moving of the optical system.

Users of the image forming apparatus are instructed to use toner which preferably satisfies the following conditions (a) to (d) as the Y, M, C, K toners used to form toner images.

(a) An average circularity of between 0.90 and 0.99.

(b) A shape factor SF-1 of between 120 and 180.

(c) A shape factor SF-2 of between 120 and 190.

(d) A particle size distribution (volume average particle diameter Dv/number average particle diameter Dn) of between 1.05 and 1.30.

As a method for instructing a user to use such a toner, a toner which satisfies all of the conditions (a) to (d) may be packaged and delivered together with the printer, for example. Alternatively, the product number or product name of the toner may be written on the printer main body or in the instruction manual, for example. As another example, the user may be informed of the product number or product name in the form of a letter, electronic data, or the like. Alternatively, the main body may be shipped as a set together with the aforementioned toner bottles BY, BC, BM, BK serving as toner storage means for storing the toner, for example. In the printer 100, all of these methods are employed, but it is sufficient to employ at least one of the methods. While each of conditions (a)-(d) are desirable, the conditions are not essential or needed to practice the invention.

The reason for prescribing a toner that satisfies the condition (a) will now be described. Namely, with toner having an average circularity of less than 0.90, or in other words toner which has more of an indeterminate form than a spherical form, the transfer quality deteriorates rapidly, and toner scattering during electrostatic transfer becomes far more likely. Further, when the average circularity is less than 0.90, it is difficult to form a high definition image having reproducibility of an appropriate concentration. When the average circularity exceeds 0.99, in a cleaning device which employs blade cleaning, cleaning defects occur in the cleaning subjects such as the photosensitive bodies and intermediate transfer belts, and hence images are more likely to become soiled. When an image with a comparatively low image area ratio is output, there is little residual toner, and hence cleaning defects rarely cause problems. However, in cases where an image with a high image area ratio, such as a color photograph, is output or an image remains on the photosensitive body without being transferred due to a sheet feeding fault or the like, cleaning defects are likely to occur. Note that a more preferable average circularity range is between 0.93 and 0.97, and it is even more preferable that toner particles having a circularity of less than 0.94 comprise no more than 10% of the total.

The average circularity of the toner can be measured in the following manner. A suspension containing toner particles of the test subject toner is drawn through an imaging portion detection belt on a flat plate, whereby images of the particles are captured optically by a CCD camera. Then, a value obtained by dividing the circumference of an equivalent circle having an equal projected area by the circumference of the actual particle is determined for each individual particle image, and an average value thereof per ten thousand particles is calculated. This average value is the average circularity.

The reasons for prescribing a toner which satisfies the conditions (b) and (c) will now be described. The shape factor SF-1 and the shape factor SF-2 are one of the parameters expressing the shape of the toner, and in the field of particle technology, are used as a parameter for tightness. Here, the shape factor SF-1 is a value expressing the degree of roundness in a spherical substance such as a toner particle. The shape factor SF-1 is a value obtained by dividing the square root of a length MXLNG of a maximum diameter location on an elliptical figure obtained by projecting a spherical substance onto a two-dimensional plane by the surface area AREA of the elliptical figure, and then multiplying this value by $100\pi/4$. In short, the shape factor SF-1 can be expressed by equation (1), set forth below. Note that a spherical substance having a shape factor SF-1 value of 100 is a perfect sphere, and the shape of the spherical substance becomes more indeterminate as the value of SF-1 increases.

$$\text{Shape factor SF-1}=\{(\text{MXLNG})^2/\text{AREA}\}\times(100\pi/4) \quad \text{Eq.1)}$$

The shape factor SF-2 is a numerical value expressing the degree of unevenness on the surface of a spherical substance. The shape factor SF-2 is a value obtained by dividing the square root of a perimeter PERI of a figure obtained by projecting the spherical substance onto a two-dimensional plane by the surface area AREA of the figure, and then multiplying this value by $100\pi/4$. In short, the shape factor SF-2 can be expressed by equation (2), set forth below. Note that a spherical substance having a shape factor SF-2 value of 100 has absolutely no unevenness on its surface. Unevenness on the surface of the spherical substance becomes more striking as the value of the shape factor SF-2 increases.

$$\text{Shape factor SF-2}=\{(\text{PERI})^2/\text{AREA}\}\times(100\pi/4) \quad \text{Eq. (2)}$$

It has been discovered through investigation that as the shape of the toner approaches a perfect sphere (as both SF-1 and SF-2 approach 100), the transfer efficiency increases. This is believed to be due to the fact that as the toner shape approaches a perfect sphere, the area of contact between a toner particle and an object which it touches (another toner particle, an image carrier, and so on) decreases, thus increasing the fluidity of the toner and weakening the adsorbability (mirroring capacity) thereof in relation to other objects. On the other hand, the shape of the toner approaches a perfect sphere, mechanical cleaning (blade cleaning or the like) becomes more difficult. This is believed to be due to the fact that as the fluidity of the toner increases, the toner becomes able to pass easily through slight gaps between the cleaning member and the cleaning subject. It becomes possible to obtain good cleaning performance by specifying in the range which mentioned above profile coefficient SF-1 and profile coefficient SF-2.

The shape factors SF-1 and SF-2 may be determined in the following manner. Using an FE-SEM (S-800), manufactured by Hitachi Ltd., 100 toner particles are selected at random, and images thereof are captured in sequence. The resulting image information is introduced into an image analyzer (LUSEX3), manufactured by Nireco Corporation, to determine MXLNG, AREA, and PERI. The shape factors SF-1, SF-2 are then calculated as an average value of 100 of the shape factors obtained according to the equations described above. When measuring the average circularity in this manner, a flow-type particle image analyzer FPIA-2100 (manufactured by SYSMEX Corporation) or the like may be used, for example. When this device is used, between 0.1 and 0.5 ml of a surfactant, preferably alkylbenzene sulfonate, is added as a dispersing agent to between 100 and 150 [ml] of water in a container from which impure solids have been removed in advance, whereupon approximately 0.1 to 0.5 [g] of the test subject toner is added thereto. This suspension is then subjected to dispersion processing for approximately one to three minutes in an ultrasonic dispersing machine, whereby the concentration of the dispersed fluid is adjusted to between 3000 and 10,000 [particles/μl]. This fluid is then applied to the device described above to measure the shape and distribution of the toner.

The reasons for prescribing a toner which satisfies the condition (d) will now be described. The particle size distribution (volume average particle diameter Dv/number average particle diameter Dn) is a parameter for expressing the particle size distribution of the toner. With a dry toner in which volume average particle diameter Dv/number average particle diameter Dn is between 1.05 and 1.30, or preferably between 1.10 and 1.25, the particle size distribution of the toner is narrow, producing various merits. Stable images can always be formed, since a phenomenon of selective development (the toner particles having a toner particle size corresponding to, or suitable to an image pattern, are selectively developed) hardly occurs. Stable images can always be formed, being hardly affected by the above actions, as the toner particle distribution is originally narrow, even though a lot of toner particles with small sizes difficult to be transferred are recycled, when a toner recycling system is loaded. With a binary developer, the variation of the toner particle size in the developer is little, even if the toner is repeatedly replenished over a long period, and a satisfactory and stable developing property is obtained, even if the toner is agitated for a long period in the developing device. With one-component developer, even if the toner is replenished, the variation of the toner particle size is little, no filming of the toner to the developing roller provided in the developing device nor welding of the toner to the member such as the blade for thinning the toner is caused, and a satisfactory and stable developing property and images are obtained, even if the toner is agitated over a long period of use of the developing device. In general, it is said that the smaller the particle size of the toner, the more advantageous for obtaining high quality images with high resolution, while smaller toner particle size is disadvantageous for transferring property and cleaning property. In the case of the toner with a volume average particle size smaller than the range mentioned above, for example, with the binary developer, the toner is welded on the surface of the carrier in a long period of agitation, causing lowering of the charging capacity of the carrier, while with the one-component developer, filming of the toner to the developing roller, or welding of the toner to members such as the blade (not shown in the figure) for thinning the toner is easily caused. These phenomena are also seen in toner with a content of fine particles larger than the range set in the present invention. In the case of the toner with the particle size larger than the above-mentioned range, reversely, high quality images with high resolution are difficult to be obtained, and the variation of the particle size of the toner are often caused, when the toner is replenished into the developer. The ratio of the volume average particle size/number average particle size (Dv/Dn) larger than 1.30 is also found to cause the same phenomena. The ratio of the volume average particle size/number average particle size (Dv/Dn) smaller than 1.05 presents a preferable aspect of stabilization of the behavior of the toner or uniformization of a charging amount. However, as functional separation by the toner particle size that thin line parts are developed by small-sized toner and solid images are developed mainly by large-sized particles is difficult to be performed, this state of the particles is not desirable.

The particle size distribution of the toner may be measured using a measurement device which works on a Coulter counter method, for example the Coulter Counter TA-II or the Coulter Multisizer II (both manufactured by Beckman Coulter Inc.). Specifically, first between 0.1 and 5 ml of a surfactant (preferably alkylbenzene sulfonate) is added as a dispersing agent to between 100 and 150 [ml] of an electrolytic aqueous solution. As the electrolytic aqueous solution, an aqueous 1% by weight NaCl solution of first-grade sodium chloride, for example ISOTON-II (manufactured by Beckman Coulter Inc.) may be used. Then, between 2 and 20 mg of a measurement sample are added to the obtained solution. The resulting solution is then subjected to dispersing processing for about 1-3 minutes in an ultrasonic dispersing machine, whereupon the measurement device described above measures the volume of the toner and the number of toner particles using a 100 μm aperture, and thus calculates the volume distribution and number distribution thereof. The volume average particle diameter Dv and number average particle diameter Dn of the toner may be determined from the obtained distributions.

Note that thirteen channels are used, namely: 2.00 to less than 2.52 &mgr; m; 2.52 to less than 3.17 &mgr;m; 3.17 to less than 4.00 &mgr;m; 4.00 to less than 5.04 &mgr;m; 5.04 to less than 6.35 &mgr;m; 6.35 to less than 8.00 &mgr;m; 8.00 to less than 10.08 &mgr;m; 10.08 to less than 12.70 &mgr; m; 12.70 to less than 16.00 &mgr;m; 16.00 to less than 20.20 &mgr;m; 20. 20 to less than 25.40 &mgr;m; 25.40 to less than 32.00 &mgr;m; and 32.00 to less than 40.30 &mgr; m, and hence toner having toner particles with a particle diameter of no less than 2.00 &mgr;m and less than 40.30 &mgr;m is used as a subject. Note that both Dv and Dn are averages per ten thousand.

In this embodiment, toner on the background surface of the photosensitive member might be transferred to a surface other than the desired face of the sheet. Toner is transferred from the surface of the intermediate transferring belt 61 to the surface of the second transferring roller 72, and the toners are transferred to the back side of sheet at the second transferring nip. Thus, the toner residue is generated on the back side of sheet.

Moreover, some image forming apparatuses form a standard toner image of a pattern defined beforehand on the surface of the intermediate transferring belt at a predetermined timing. These image forming apparatuses adjust the image forming conditions, such as the development bias and timing of writing, based on the result of the standard toner image detected by the sensor. In this case, toner of the standard toner image causes the toner drift.

The following describes the specific points of this embodiment.

Figure 4:
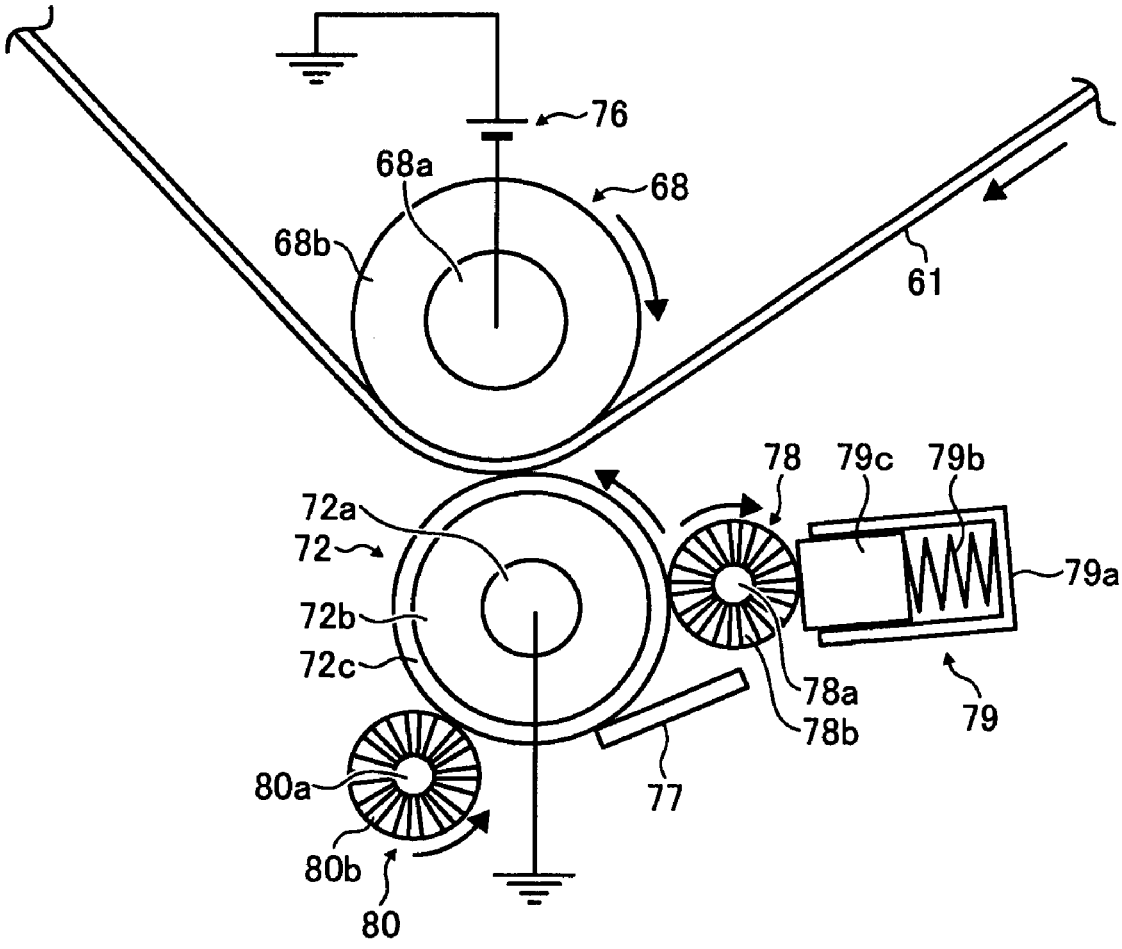
FIG. 4 is an enlarged view of a secondary transferring nip of the image forming apparatus.

FIG. 4 is an enlarged view of a secondary transferring nip of the image forming apparatus.

As described above, the second transferring backup roller 68 is applied with a second transferring bias, which has same polarity as the polarity of the toner, using a power source (not shown). The second transferring roller 72 is rotated in the same direction as the direction of surface movement of the intermediate transferring belt 61 at the second transferring area, and the second transferring roller 72 is grounded. The second transferring backup roller 68 includes a cylindrical core 68*a* made of metal, and an elasticity layer 68*b* coated on the peripheral surface of the cylindrical core 68*a*. The elasticity layer 68*b* is made of an elastic material, e.g., rubber, which includes ion conductive agents or conductive fine particles decentrally, and the elasticity later 68*b* have a little conductivity. The electric resistance of the elasticity layer 68*b* is preferably Log Ω6.5 or more, for example, although other values may be utilized.

An excellent second transfer can be obtained even if a small size sheet such as the A5 size is passed through the second transferring nip by selecting an appropriate electric resistance of the elastic layer 68*b*. By selecting a bigger electrical resistance of the elasticity layer 68*b* than the electrical resistance of a sheet, the situation of having the second transfer current too intense at the area (direct contact area of the intermediate transferring belt 61 and the second transferring roller 72) where the sheet in the second transferring nip doesn't exist can be evaded.

The second roller 72 includes a cylindrical core 72*a* made of metal, an elasticity layer 72*b* coated on the peripheral surface of the cylindrical core 72*a*, and a surface layer 72C coated on the peripheral surface of the elasticity layer 72*b*. Most metallic materials can be used as a metallic material of the cylindrical core 72*a* of the second transferring roller 72, but stainless steel and, aluminum are particularly suitable. Rubber may be used as the material of the elasticity layer 72*b* of the second transferring roller 72. Moreover, fluoro-resin may be used as the material of the surface layer 72*c*.

The second transferring roller 72 is generally flexible by having moderate elasticity of the elasticity layer 72*b*. This widens the contact area of the intermediate transferring belt 61 and the second transferring roller 72 and improves adhesion. The elasticity layer 72*b* includes conductive fine particles in the rubber which have elasticity to have a proper conductivity. Ethylene propylene diene rubber or silicon rubber, which include carbon particles decentrally, can be used for the conductive fine particles. In addition, nitrile rubber and polyurethane rubber which include ion conductive agents can be used for the conductive fine particles. The second transferring roller 72 preferably has a JIS-A hardness of under 70 degree to make the second transferring nipwide, although other hardnesses are possible. The second transferring roller 72 has a JIS-A hardness of over 40 degrees to make the contact angle between the second transferring roller 72 and a second transferring roller cleaning blade 77 stable. In this embodiment, the elasticity layer 72*b* is made of epichlorohydrin rubber which has a JIS-A hardness of 50 degrees.

Because many rubber materials have a comparatively high chemical affinity for toner, toner mold release characteristics may be bad. In addition, many rubber materials have a comparatively big friction resistance. Superior toner mold release characteristics and low frictional resistance of the surface of the second transferring roller 72 are desired to get good cleaning characteristics, to prevent a blade burr of the second transferring roller cleaning blade 77, and to control destabilization of the belt drive speed by the linear speed difference with the intermediate transferring belt 61. Thus, in this embodiment, the second transferring roller 72 is coated with the fluoro-resin as the surface layer 72*c* on the surface of the elasticity layer 72*b*. This gives the second transferring roller 72 superior toner mold release characteristics and low frictional resistance.

The coefficient of friction of the surface of the second transferring roller 72 is preferably 0.4 or less, although other values are possible. A lubricant supplying brush 78, which is made to rotate a turn in the clockwise direction by a power source such as a motor (not shown), is arranged on the right side of the second transferring roller 72. The lubricant supplying roller 78 includes a rotation shaft member 78*a* made of the metal, supported freely by the shaft carrier (not shown) and a brush roller part 78*b* which has fibers arranged on the surface of the rotation shaft member 78*a*.

The brush roller part 78*b* of the lubricant supplying roller 78 contacts the surface of the second transferring roller 72, and the lubricant supplying brush 78 is rotated in the same direction as the direction of the surface movement of the second transferring roller 72 at the nip between the lubricant supplying roller 78 and the second transferring roller 72. A lubricant supplying unit 79 is arranged to the right of the lubricant supplying roller 78. The lubricant supplying unit 79 includes a spring 79*b* and a solid lubricant 79*c* made of, for example, zinc stearate in a case 79*a*. The spring 79*b* pushes the solid lubricant 79*c* to the brush roller part 78*b* of the lubricant supplying roller 78. The lubricant supplying roller 78 rotates while contacting the brush roller part 78*b* to the solid lubricant 79*c* and the second transferring roller 72. The lubricant supplying roller 78 supplies the lubricant, which is scratched from the solid lubricant 79*c*, to the surface of the second transferring roller 72, just before the contacted portion of the second transferring roller 72 advances to the second transferring nip.

By applying the lubricant to the surface of the second transferring roller 72, the adhesion of the surface of the second transferring roller 72 to toner becomes weak, and the toner removal characteristics from the surface of the second transferring roller 72 improves. In addition, damage of the surface of the second transferring roller 72 by touching the second transferring roller cleaning blade 77 is suppressed. As the lubricant 79*c* is scratched, the length of the solid lubricant 79*c* decreases. As the length of the solid lubricant is reduced, the solid lubricant 79*c* is pushed out to the lubricant supplying roller 78 by the spring 79*c*. Thus, even if the length of the solid lubricant 79*c* decreases, the solid lubricant 79*c* continues to contact the lubricant supplying roller 78.

In the lower right of FIG. 4, the free edge of the second transferring roller cleaning blade 77, which is supported by a supporting member, contacts the surface of the second transferring roller 72. The second transferring roller cleaning blade 77 contacts the surface of the second transferring roller 72 between the second transferring nip which is between the second transferring roller 72 and the intermediate transferring belt 61, and the nip which is between the second transferring roller 72 and the lubricant transferring roller 78. Thus, the second transferring roller cleaning blade 77 removes residual toner on the surface of the second transferring roller 72 before it goes into the nip between the second transferring roller 72 and the lubricant supplying brush 78.

In this embodiment, a foreign material removing brush 80 is located between the second transferring nip which is between the second transferring roller 72 and the intermediate transferring belt 61, and the nip which is located between the second transferring roller cleaning blade 77 and the second transferring roller 72, and removes foreign materials, e.g. sheet powder (which is bigger than toner), on the surface of the second transferring roller 72. The foreign material removing brush 80 includes a rotation shaft member 80*a* made of metal, supported freely by a shaft carrier, and a brush roller part 80*b* having fibers arranged on the surface of the rotation shaft member 80*a*. The brush roller part 80*b* of the foreign material removing brush 80 contacts the surface of the second transferring roller 72, and the foreign material removing brush 80 is rotated in the same direction as the direction of the surface movement of the second transferring roller 72 at the nip between the second transferring roller cleaning blade 77 and the second transferring roller 72. Thus, foreign materials on the surface of the second transferring roller 72 are removed.

In this embodiment, the toner residue on the back side of the sheet due to the second transferring nip is prevented for a long time in spite of high pressure of the second transferring roller cleaning blade 77 to remove the spherical toners, which are usually difficult to be removed. The arrangement of the invention utilizes the foreign material removing brush 80 to remove sheet powder on the surface of the second transferring roller 72 before the sheet powder goes into the nip between the second transferring roller cleaning blade 77 and the second transferring roller 72.

The other way to supply lubricant to the surface of the second transferring roller 72 is by supplying the solid lubricant directly to the surface of the second transferring roller 72. But, in this way, if foreign material goes into the nip between the solid lubricant and the second transferring roller 72, the foreign material may stay indefinitely buried in the solid lubricant. Then, the foreign material may damage the surface of the second transferring roller 72 by the contacting the surface of the second transferring roller 72 for a long time. This damage may cause toner residue on the back side of the sheet having a toner image to have poor adhesion between the second transferring roller cleaning blade 77 and the second transferring roller 72. Thus, the second transferring roller 72 may need to be changed within a short period of time comparatively. However, if desired, this arrangement may be utilized.

In contrast, in this embodiment, even if foreign material goes into the nip between the lubricant supplying brush 78 and the second transferring roller 72, the lubricant supplying brush 78 traps the foreign material, and prevents damage of the surface of the second transferring roller 72. In addition, when the solid lubricant 79*c* is supplied to the surface of the second transferring roller 72 directly, the amount of the lubricant supplied to the second transferring roller 72 depends on the pressure that is applied to the solid lubricant 79*c* towards the second transferring roller 72. The pressure decreases according to the consumption of the solid lubricant 79*c*, and the amount of the lubricant supplied to the second transferring roller 72 is not stable.

On the other hand, in this embodiment, the dependability of the amount of the lubricant applied to the surface of the second transferring roller 72 based on the above-mentioned pressure is reduced by having established the process of scratching the solid lubricant 79*c* with the lubricant supplying brush 78. Thus, the amount of the lubricant supplied to the second transferring roller 72 can be stable.

Another way to supply the lubricant to the surface of the second transferring roller 72 is by supplying the solid lubricant 79*c* directly to the foreign material removing brush 80 without the lubricant supplying roller 78. But, in this way, the lubricant is supplied to the surface of the second transferring roller 72 where the toner may not have been removed. In other words, the lubricant is supplied from the top of the toner for the toner adhesion area of the surface of the second transferring roller 72. Then, since the lubricant does not intervene between the toner and the surface of the second transferring roller 72 in the toner adhesion area, poor cleaning due to aggravation of the toner mold-release characteristic will be caused. In contrast, in this embodiment, the lubricant is applied to the surface of the second transferring roller 72 where the toner is removed by the second transferring roller cleaning blade 77, and it can prevent poor cleaning.

Recently, foreign-made cheap sheets have begun to appear on the market. For example, some sheets contain too much calcium carbonate. The present inventor has found that the toner residue on the back side of a sheet due to poor cleaning of the second transferring roller 72 occurs in a short time for sheets which contain too much calcium carbonate. Further, calcium carbonate contained in the sheets adheres to the surface of the second transferring roller 72, and the adhesion of calcium carbonate in the gap between the second transferring roller cleaning blade 77 and the second transferring roller 72 causes poor cleaning of the second transferring roller 72.

In this embodiment, the foreign material removing brush 80 is arranged upstream of the nip between the second transferring roller cleaning blade 77 and the second transferring roller 72 to remove sheet powder on the surface of the second transferring roller 72. But, fine particles of calcium carbonate are not removed by the foreign material removing brush 80, and the fine particles may go into the nip between the second transferring roller cleaning blade 77 and the second transferring roller 72. Also, the fine particles adhere on the surface of the second transferring roller 72 by the striking of the second transferring roller 72 and the second transferring roller cleaning blade 77.

It was thought that it could be more effective to increase the amount of lubricant applied to the surface of the second transferring roller 72 to suppress the adherence of such calcium carbonate. An experiment was performed to check a state of images formed on a recording medium by altering the pressure of the spring 79*b* and changing the amount of the lubricant applied to the surface of the second transferring roller 72. Six springs, which have different pressures, were used as the spring 79*b*. The pressure of the six springs was 0.8, 1.0, 1.2, 1.6, 2.0 and 2.4 [N], respectively. The solid lubricant 79*c* can be strongly pushed against the lubricant supplying roller 78 using a spring with a strong pressure, which increases the amount of lubricant applied to the surface of the second transferring roller 72.

The amount of lubricant supplied to the surface of the second transferring roller 72 is measured as a consumption of the solid lubricant 79*c* per 1000 [m] of the amount of surface movement of the second transferring roller 72, per unit length of the direction which intersects perpendicularly with the brush roller. After the solid lubricant 79*c* of the initial state is weighed, the solid lubricant 79*c* is set in the image forming apparatus. Then, test images are generated until the amount of surface movement of the second transferring roller 72 amounts to 1000 [m]. After that, the solid lubricant 79*c* is removed from the image forming apparatus, the weight is measured and deducted from initial weight to determine the weight consumed.

The consumption of the solid lubricant 79*c* is determined by dividing the weight consumed by the length of the direction which intersects perpendicularly with the brush roller in the contact part of the solid lubricant 79*c* and the lubricant supplying brush 78. In this embodiment, the solid lubricant has 313 [mm] of width in the direction of the axis of the lubricant supplying roller 78, and the lubricant supplying roller 78 contacts the whole width of the solid lubricant. Thus, the subtraction result is divided by 313 [mm].

Sheets with increased calcium carbonate (e.g., My Recycle Sheet of Ricoh) were used. As for outputting consecutive sheets, measurement was done based on ten consecutive sheets because it is assumed that the average number of sheets in a print job is typically ten.

The diameter of the second transferring roller 72 is 24 mm, and the second transferring roller 72 is rotated at the speed of 220 rpm during outputting of consecutive sheets. The diameter of the foreign material removing roller 80 is 14 mm, and this roller 80 is rotated at the speed of 300 rpm during outputting of consecutive sheets. The second transferring roller 72 rotates in the opposite direction of the rotation direction of the foreign material removing brush 80. The average diameter of toner particles is 5.5 μm, and an average roundness of the toner particles is 0.96. The second transferring roller cleaning blade 77 contacts the second transferring roller 72 at a pressure of 0.24 N/m.

Testing was performed to evaluate (1) adhesion on the surface of the second transferring roller 72, (2) the presence of toner residue on the back side of sheet due to poor cleaning of the second transferring roller 72, (3) the occurrence of sheet jams due to excessive dispersion of the lubricant from the lubricant supplying brush 78, and (4) the occurrence of damage on the surface of the second transferring roller 72. During this testing, the pressure of the spring 79*b* was altered which affected the amount of lubricant which was dispersed. The result of generating a consecutive output is shown in table 1 based on 1000 [m] of movement of the surface of the second transferring roller 72.

TABLE 1

| Pressure of the spring [N] | Amount of lubricant used [mg/mm] | Adhesion | Toner residue | Sheet jam | Damage |
|---|---|---|---|---|---|
| 0.8 | 0.03 | X | X | ○ | ○ |
| 1.0 | 0.05 | ○ | ○ | ○ | ○ |
| 1.2 | 0.09 | ○ | ○ | ○ | ○ |
| 1.6 | 0.19 | ○ | ○ | ○ | ○ |
| 2.0 | 0.38 | ○ | ○ | ○ | ○ |
| 2.4 | 0.52 | ○ | ○ | X | ○ |

○: not present
X: present

As shown in Table 1, when the consumed amount of lubricant per unit length of the direction which intersects perpendicularly with the brush roller is over 0.05 mg/mm due to the pressure of the spring 79*b*, it can prevent the presence of the adhesion on the surface of the second transferring roller 72. At the same time, the invention prevents toner from adhering to the back side of a sheet due to poor cleaning of the second transferring roller by the cleaning blade 77. On the other hand, when the amount of the lubricant is over 0.52 mg/mm due to the pressure of the spring 79*b*, sheet jams may occur due to excessive dispersion of lubricant by the lubricant supplying brush 78.

Furthermore, by dispensing lubricant in the amount shown in the table, damage on the surface of the second transferring roller 72 can be avoided. Sheet jams occur when excessive dispersion of lubricant from the lubricant supplying brush 78 adhere to the surface of the sheet transferring roller, e.g., the registration roller 37.

In view of the experimental results, the spring 79*b*, which has pressure from 1.0 to 2.0 N, is used to adjust the amount of the lubricant from 0.05 to 0.38 mg/mm. Thus, even if the sheets contain a large amount of calcium carbonate, the invention can prevent the presence of the toner residue on the back of sheets due to the adhesion of calcium carbonate on the surface of the second transferring roller 72. Further, the present invention prevents sheet jams by excessive dispersion of the lubricant from the lubricant supplying brush 78.

In this embodiment, the solid lubricant is made of zinc stearate. The zinc stearate is easily scraped, so the lubricant supplying roller 78 can scrape the solid lubricant easily, and can supply the lubricant to the surface of the second transferring roller 72. In addition, the lubricant supplying roller 78 includes the rotation shaft member 78*a* and the brush roller part 78*b* which polyester fibers arranged on the surface of the rotation shaft member 78*a*. With this construction, the invention can easily supply the lubricant to the surface of the second transferring roller 72 by contacting with the brush roller part 78*b*, shaving or brushing the solid lubricant 79*c*. Furthermore, the invention can reduce the occurrence of the brush collapsing or being napped in comparison with when the brush roller part 78*b* having a lot of fibers made of acrylic is used.

In this embodiment, a width of the solid lubricant 79*c* is bigger than a width of the second transferring roller cleaning blade 77. Also, a width of the lubricant supplying roller 78 is bigger than a width of the second transferring roller cleaning blade 77. With this construction, the invention can supply the lubricant to the whole region of the toner removal width at the surface of the second transferring roller 72.

Obviously, numerous additional modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. A transferring device installed in an image forming apparatus, comprising:

an image bearing member configured to bear toner images on a surface of the image bearing member;

a transferring member configured to contact the image bearing member to form a transferring nip between the image bearing member and the transferring member, wherein the toner images are transferred to a recording medium at the transferring nip;

a lubricant supplying member configured to supply a lubricant to a surface of the transferring member;

a transferring member cleaning member configured to remove residual toner from the transferring member, the transferring member cleaning member contacting the surface of the transferring member such that the lubricant supplying member is between the transferring member cleaning member and the transferring nip; and a foreign material removing member configured to remove residual foreign material from the surface of the transferring member at a position between the transferring nip and the transferring member cleaning member.

2. The transferring device according to claim 1, wherein;

the lubricant supplying member includes a lubricant supplying roller in contact with a solid lubricant part, and a consumption of the lubricant per unit length of a direction which intersects perpendicularly with a contact point between the lubricant supplying roller and the solid lubricant part is over 0.05 mg/mm per 1000 m of the amount of surface movement of the transferring member.

3. The transferring device according to claim 2, wherein;

the consumption is under 0.38 mg/mm.

4. The transferring device according to claim 1, wherein;

the lubricant comprises zinc stearate.

5. The transferring device according to claim 1, wherein;

the lubricant supplying member includes a lubricant supplying roller, which includes a rotation shaft member and a brush roller part comprising polyester fibers.

6. The transferring device according to claim 1, wherein;

a width of the lubricant is larger than a width of the transferring member cleaning member, and a width of the lubricant supplying member is larger than the width of the transferring member cleaning member.

7. The transferring device according to claim 1, wherein;

the transferring member includes a surface layer made of fluoro-resin.

8. The transferring device according to claim 1, wherein;

the transferring member has a JIS-A hardness from 40 to 70 degrees.

9. The transferring device according to claim 1, wherein;

a coefficient of friction of the surface of the transferring member is 0.4 or less.

10. The transferring device according to claim 1, wherein:

the transferring member cleaning member is a blade.

11. The transferring device according to claim 1, wherein:

the foreign material removing member is a brush roller.

12. An image forming apparatus comprising:

an image bearing member configured to bear toner images on a surface of the image bearing member;

at least one light generator configured to form electrostatic images corresponding to the toner images;

at least one developer configured to develop the electrostatic images into the toner images;

a transferring member configured to contact the image bearing member to form a transferring nip between the image bearing member and the transferring member, wherein the toner images are transferred to a recording medium at the transferring nip;

a lubricant supplying member configured to supply a lubricant to a surface of the transferring member, a transferring member cleaning member configured to remove residual toner from the transferring member, the transferring member cleaning member contacting the surface of the transferring member such that the lubricant supplying member is between the transferring member cleaning member and the transferring nip; and a foreign material removing member configured to remove residual foreign material from the surface of the transferring member at a position between the transferring nip and the transferring member cleaning member.

13. The image forming apparatus according to claim 12, wherein;

the lubricant supplying member includes a lubricant supplying roller in contact with a solid lubricant part, and a consumption of the lubricant per unit length of a direction which intersects perpendicularly with a contact point between the lubricant supplying roller and the solid lubricant part is over 0.05 mg/mm per 1000 m of the amount of surface movement of the transferring member.

14. The image forming apparatus according to claim 13, wherein;

the consumption is under 0.38 mg/mm.

15. The image forming apparatus according to claim 12, wherein;

the lubricant is made of zinc stearate.

16. The image forming apparatus according to claim 12, wherein;

the lubricant supplying member includes a lubricant supplying roller, which includes a rotation shaft member and a brush roller part having fibers made of polyester arranged on the surface of the rotation shaft member.

17. The image forming apparatus according to claim 12, wherein;

a width of the lubricant is bigger than a width of the image bearing member cleaning member, and a width of the lubricant supplying member is bigger than the width of the image bearing member cleaning member.

18. The image forming apparatus according to claim 12, wherein;

the transferring member includes a surface layer made of fluoro-resin.

19. The image forming apparatus according to claim 12, wherein;

the transferring member has a JIS-A hardness from 40 to 70 degrees.

20. The image forming apparatus according to claim 12, wherein;

a coefficient of friction of the surface of the transferring member is 0.4 or less.

21. The image forming apparatus according to claim 12, wherein:

the transferring member cleaning member is a blade.

22. The image forming apparatus according to claim 12, wherein:

the foreign material removing member is a brush roller.

* * * * *